US005878666A

United States Patent [19]

Schneider et al.

[11] Patent Number: 5,878,666

[45] **Date of Patent: *Mar. 9, 1999**

[54] PRINTING MACHINE WITH AT LEAST ONE INTERCHANGEABLE CYLINDER

[75] Inventors: Josef Schneider, Diedorf; Josef Göttling, Friedberg, both of Germany

[73] Assignee: MAN Roland Druckmaschinen AG., Offenbach Am Main, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 730,754

[22] Filed: Oct. 15, 1996

Related U.S. Application Data

[63] Continuation-in-part of Ser. No. 294,136, Aug. 22, 1994, abandoned.

[30] Foreign Application Priority Data

Aug. 20, 1993 [DE] Germany ..... 43 28 058.7

[51] Int. Cl.[6] ..... B41F 27/06; B41F 30/40

[52] U.S. Cl. ..... 101/217; 101/375

[58] Field of Search ..... 101/247, 375, 101/216, 219, 376, 352, 182

[56] References Cited

U.S. PATENT DOCUMENTS

| | | | |
|---|---|---|---|
| 2,707,530 | 5/1955 | Bromberg . | |
| 3,384,012 | 5/1968 | Zernovf | 101/216 |
| 3,604,350 | 9/1971 | Rosenstadt | 101/182 |
| 3,783,782 | 1/1974 | Hardt | 101/216 |
| 3,789,757 | 2/1974 | Motter et al. . | |
| 3,892,178 | 7/1975 | Staamann | 101/177 |
| 4,375,936 | 3/1983 | Dechantsreiter . | |
| 4,386,566 | 6/1983 | Moss | 101/375 |
| 4,413,541 | 11/1983 | Biggar | 83/346 |
| 4,807,527 | 2/1989 | Knauer | 101/216 |
| 4,823,693 | 4/1989 | Kobler | 101/375 |
| 5,142,978 | 9/1992 | Borel . | |
| 5,186,103 | 2/1993 | Gelinas et al. . | |
| 5,570,633 | 11/1996 | Schultz et al. | 101/182 |

FOREIGN PATENT DOCUMENTS

| | | |
|---|---|---|
| 453 973 | 10/1991 | European Pat. Off. . |
| 822539 | 11/1951 | Germany . |
| 1922274 | 11/1970 | Germany . |
| 3222717 | 12/1983 | Germany . |
| 8233414 | 3/1984 | Germany . |
| 3517634 | 4/1990 | Germany . |
| 4240487 | 12/1993 | Germany . |
| 57-107845 | 7/1982 | Japan . |
| 58-163243 | 10/1983 | Japan . |
| 1-206048 | 8/1989 | Japan . |
| 2-130330 | 10/1990 | Japan . |
| 5-77391 | 3/1993 | Japan . |
| 5-162281 | 6/1993 | Japan . |
| 571397 | 1/1976 | Switzerland . |
| 590129 | 7/1977 | Switzerland . |
| 647613 | 8/1948 | United Kingdom . |
| 9207716 | 5/1992 | WIPO . |

*Primary Examiner*—J. Reed Fisher
*Attorney, Agent, or Firm*—Cohen, Pontani, Lieberman & Pavane

[57] ABSTRACT

A printing machine, having side walls and at least one form cylinder with an outer cylindrical surface carrying a removable sleeve-shaped printing form, the form cylinder having journals and being removably mounted in the side walls. A bearing rotatably supports the journals in the sidewalls and at least one of the side walls has an opening. A transport device moves the form cylinder back and forth through the opening in the side wall so that the sleeve of the form cylinder removed from the printing machine can be exchanged for a replacement sleeve and the form cylinder with the replacement sleeve can be moved back into the printing machine.

13 Claims, 7 Drawing Sheets

PRINTING MACHINE WITH AT LEAST ONE INTERCHANGEABLE CYLINDER

This is a continuation-in-part application under 37 C.F.R. §1.53 of U.S. patent application Ser. No. 08/294,136 filed AUG. 22, 1994, now abandoned.

BACKGROUND OF THE INVENTION

1. Field of the Invention

The invention relates to a printing machine with at least one form cylinder that carries a sleeve-shaped printing form which adheres frictionally to the outer cylindrical surface of the form cylinder and can be exchanged for a replacement sleeve by being removed from the outer cylindrical surface. The form cylinder is installed in the printing machine in a bearing, from which it can be removed, and has permanent preset interfaces to ensure that its bearing in the printing machine is correct in respect to the lateral and the circumferential register. There is a removal assembly to remove the form cylinder from its bearing. There is also a holder to hold the form cylinder at one of its journals, while the other journal is free, and a sleeve-changing device to remove the sleeve from the form cylinder and exchange it for the replacement sleeve.

2. Description of the Prior Art

From U.S. Pat. No. Re. 33,994, a printing machine is known that has an opening in its side wall so that a sleeve can be slipped through the opening onto a cylinder mounted in the printing machine. The cylinder is mounted and held at its journal on one side in the opposite side wall, while the other journal is uncovered.

SUMMARY OF THE INVENTION

The object of the present invention is to create a form cylinder that can be equipped in a simple manner with a replacement sleeve carrying a new printing image. A device that applies the printing image to the sleeves is provided outside of the printing machine.

The invention also relates to the sleeve of a transfer cylinder. This sleeve can be removed from the printing machine in the same manner described in greater detail below in reference to the sleeve of a form cylinder.

Pursuant to these objects, and others which will become apparent hereafter, one aspect of the present invention resides in a printing machine having at least one form cylinder which carries a removable sleeve-shaped printing form on its outer cylindrical surface. The form cylinder has journals which are removably mounted in sidewalls of the printing machine. Bearing means are provided for rotatably and removably supporting the journals in the sidewalls. The form cylinder has permanently preset interfaces for the bearing, on the printing machine, in a manner correct with respect to the lateral and circumferential register. A sleeve-change device is provided to remove the sleeve from the form cylinder and to exchange it for a replacement sleeve. Transport means are provided for moving the form cylinder back and forth through the opening in the sidewall so that the sleeve of the form cylinder removed from the printing machine can be exchanged for a replacement sleeve and the form cylinder with the replacement sleeve can be moved back into the printing machine for further printing.

In another embodiment of the invention the transport means includes either a transport car or a transport carriage.

In another embodiment of the invention one of the journals of the form cylinder has a first part, a second part and a coupling configured so that the first part of the drive side journal remains in one of the sidewalls while the second part of the journal remains with the form cylinder and can be moved out of the printing machine by the transport means.

In still another embodiment the transport means includes a positioning device having clamping jaws configured to hold the journals of the form cylinder.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
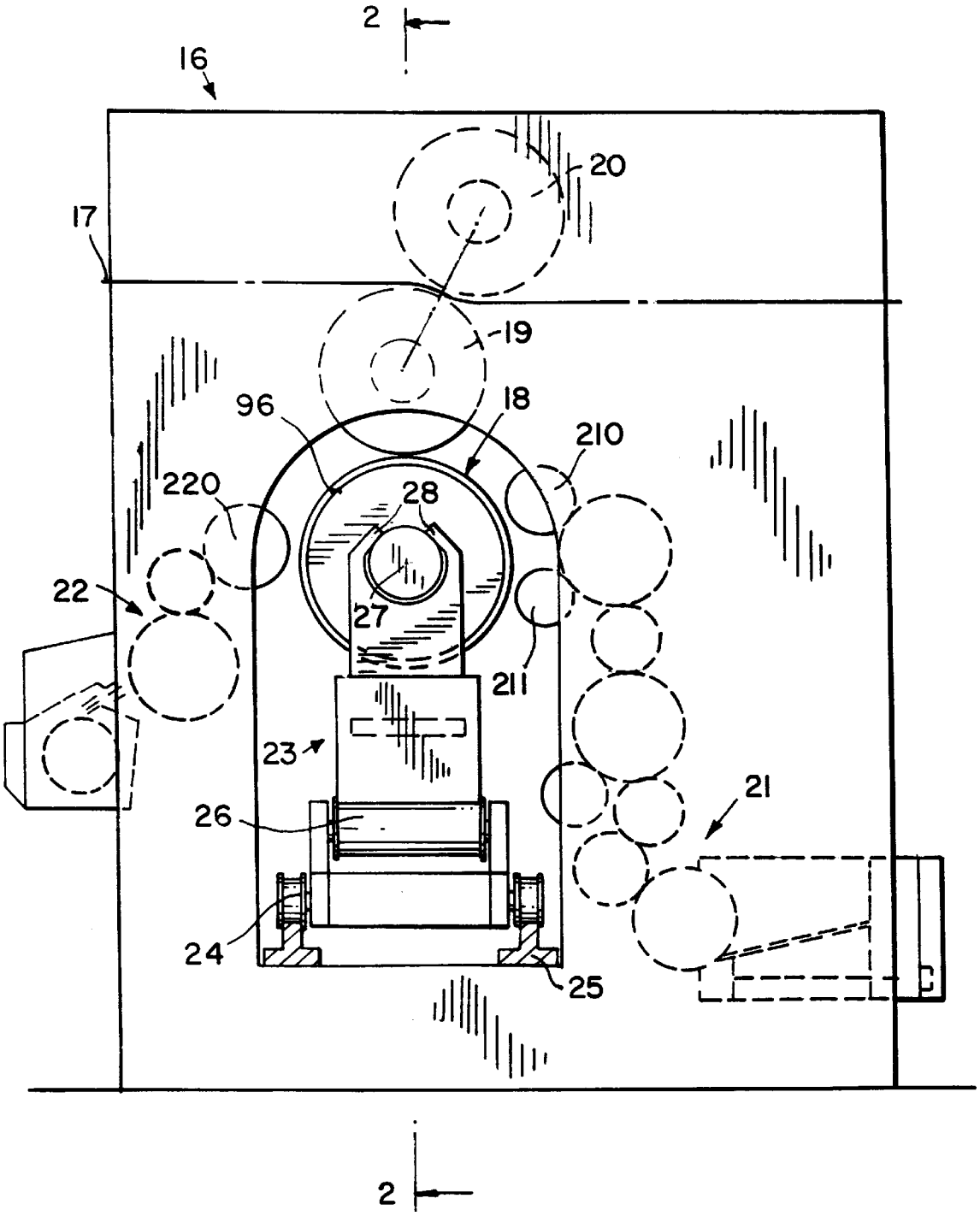
FIG. 1 is a side view of an offset printing machine.

A web 17 is printed in a rotary printing machine 16. For this purpose, the rotary printing machine 16 has a form cylinder 18, a transfer cylinder 19 and a printing cylinder 20. The form cylinder 18 carries an exchangeable sleeve 96, which frictionally adheres to the outer cylindrical surface of the cylinder 18 and on which the image to be printed is located. The form cylinder 18 is inked by an inking unit 21 with the ink application rollers 210, 211. In the event that the rotary printing machine 16 prints in a wet offset process, a wetting agent is supplied by a wetting unit 22 with a wetting application roller 220. The form cylinder 18 is loaded on a transport car 23. The transport car 23 can be moved into and out of the rotary printing machine 16 by means of rollers 24 on tracks or rails 25. The transport car 23 has a holder 26, which holds the journals 27, 27' of the form cylinder 18 when the form cylinder 18 is to be moved out of the rotary printing machine 16.

After a print job ends and as soon as the eccentrically-mounted transfer cylinder 19, for example, has been positioned away from the form cylinder 18, the journals 27, 27' of the form cylinder 18 are held in place by the clamping jaws 28, which are attached to the holder 26 in pivotable fashion, in order to prevent the form cylinder 18 from turning in the holder 26.

Figure 7:
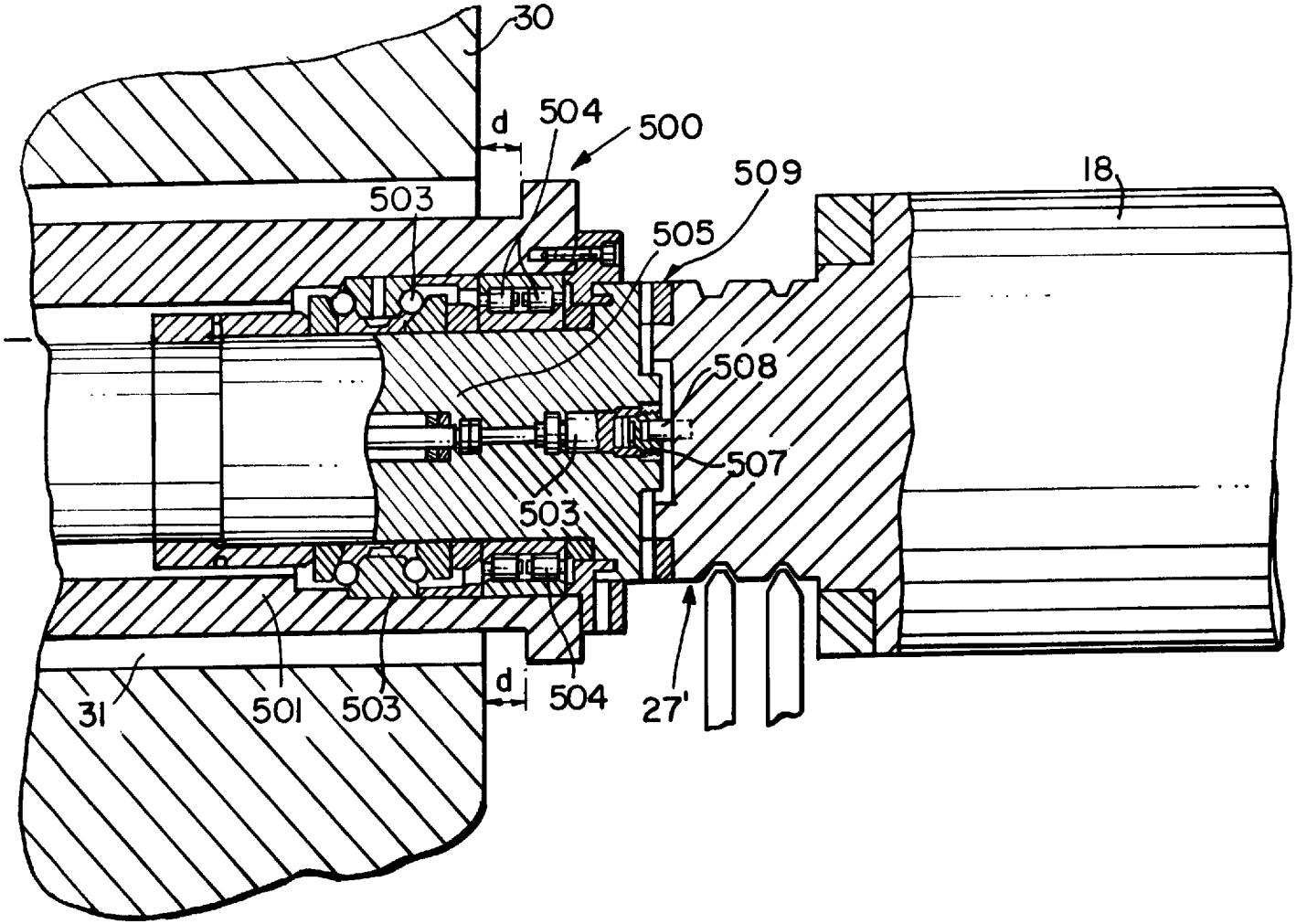
FIG. 7 is a cross-section of a form cylinder and its mounting in the printing machine.

The transport car 23 (FIG. 2) has a positioning device 29, which is arranged on the holder 26 and can tilt the form cylinder 18 into a vertical position. During printing, the form cylinder 18 is mounted in stationary fashion on one side in a permanent side wall 30 in a bearing, e.g., a ball or roller bearing 31. The driving means for the form cylinder 18, the transfer cylinder 19 and the printing cylinder 20 are also located in the vicinity of the side wall 30. These cylinders are either directly driven by their own respective electric motors or are connected by means of the toothed gears 32, 33, 34, which intermesh with one another. The drive-side journal 27' mounted in the side wall 30 is constructed in two parts. Its two parts are connected to one another in a turn-proof fashion by a coupling 35, for example, a claw coupling. An example of such a construction of a journal and coupling is shown in FIG. 7. Here, the form cylinder 18 is installed, using a journal pin 505, above a mounting 500 in the sidewall 30. The mounting 500 includes a bearing bushing 31 with hydraulic clamping, in which a bearing sleeve 501 is movably located within an area d parallel to the longitudinal axis of the form cylinder 18. Via an axial bearing 503 and a radial bearing 504, the journal pin 505 for the form cylinder 18 is movably located in the bearing sleeve 501. The journal pin 505 is also equipped with a form cylinder clamping mechanism 506 which has clamping jaws 507. The clamping jaws encircle a corresponding fastening pin 508 of the form cylinder 18 and are, for example, pneumatically loaded and relieved. In addition, the form cylinder 18 and the journal pin 505 each have a corresponding serration 509, for example, a Hirth-type serration, through which the form cylinder 18 is held and centered on the shaft. Hirth-type serrations of toothings are conventional and known to those skilled in the art, and thus will not be described here in detail.

It will be further recognized and understood that instead of the serration 509 shown here, other types of serrations may be used, for example, serrations in which the teeth are slanted at the roots so that the form cylinder 18 is self-centering when placed in the printing machine, and further, in order to precisely establish the position of the form cylinder 18 during its removal or during its return. Mechanical, optical or electronic positioning means can be used alone or in conjunction with these serrations.

Furthermore, a correct mounting of the cylinder in terms of circumferential registers is important, not only in the case of the form cylinder, but also for example, in the case of the transfer cylinder, if the latter has no seamless rubber sleeve. Correct mounting is also important in the case of the form inking roller, if the form cylinder has one or more channels and the inking roller has corresponding reliefs in the contour of its core where, instead of the core material, there are protrusions of its outer covering which respectively roll off the channels of the form cylinder.

In the other side wall 36 of the rotary printing machine 16, there is a side wall part (not shown here) that can be removed from the side wall 36 in order to uncover the form cylinder 18. The other journal 27 of the form cylinder 18 is mounted in this side wall part. Before the side wall part is removed, the one-piece journal 27 and the side wall part, which can be removed by loosening the coupling 35 of the two-part journal 27', are held by a positioning device 29. The positioning device 29 surrounds the movable arc-shaped segments 37, 38. In the region bordering the segments 37, 38, the stationary positioning device 29 is constructed in an arc-shaped fashion. This region serves as the guide for the movable segments 37, 38. The segments 37, 38 have toothings and can thus be moved by the toothed gear drives 39, 40 in the direction of the double arrows C and D. After the segments 37 and 38 have been moved forward from their rest positions into the positions 37' and 38' and the clamping jaws 28 have securely clamped the journals 27, 27', the form cylinder 18 is moved out of the rotary printing machine 16.

Figure 3:
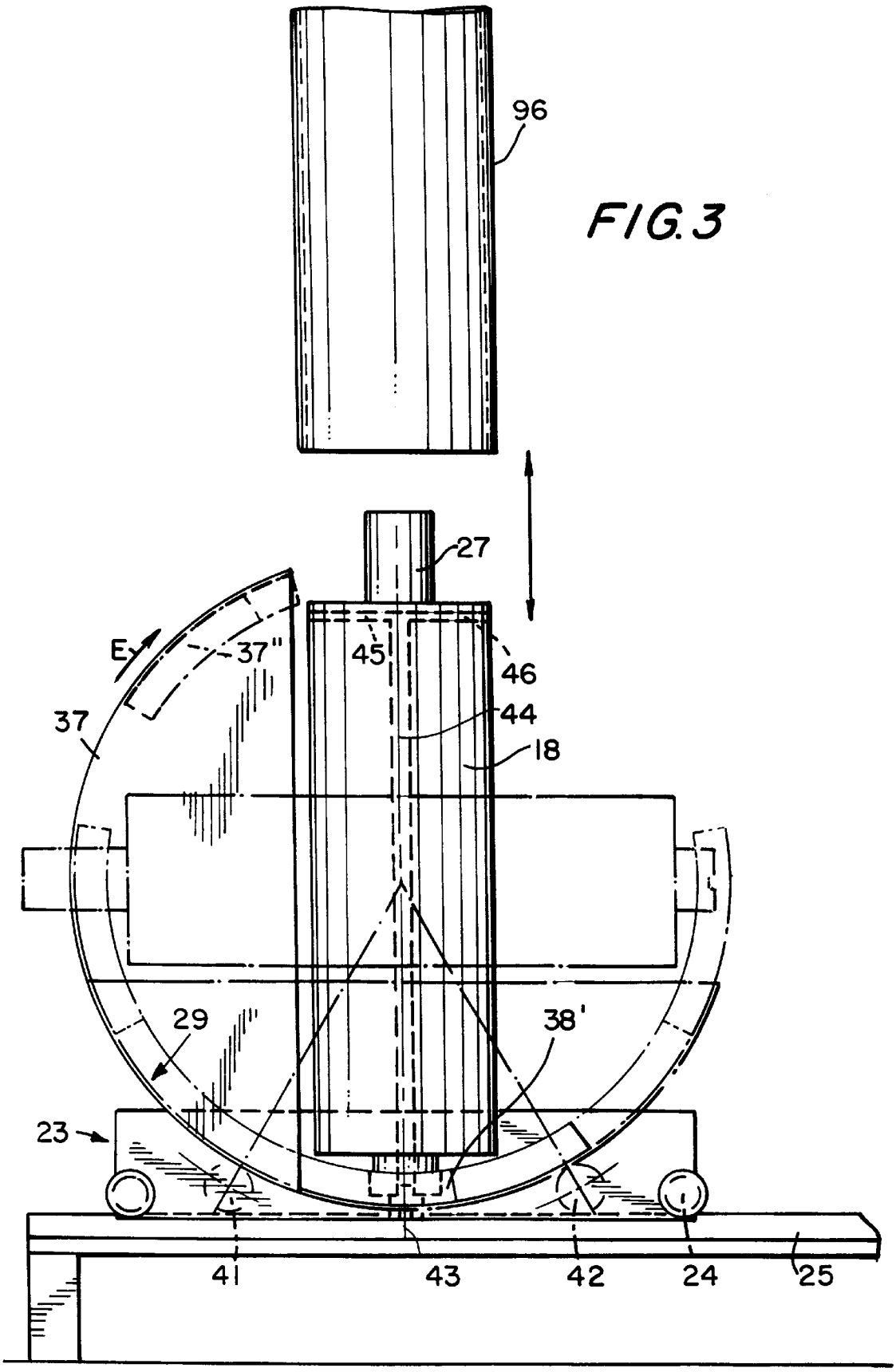
FIG. 3 is a view of a first transport means, which carries a form cylinder.

After this, the form cylinder is tilted by 90° on the transport car 23 (FIG. 3). For this purpose, the positioning device 29, which rests via an arc-shaped toothing on the driven toothed gears 41, 42 on the holder 26, is turned in the direction of Arrow E until the form cylinder 18 stands vertically on the transport car 23. Then the clamping jaws 28 that hold the journal 27 are released, and the segment 37 is moved into the position 37' shown in FIG. 3, while the segment 38 remains in its position. By means of a pressurized air feed 43, pressurized air is introduced into the journal 27. From there, the pressurized air is conducted via the line 44 located in the interior of the form cylinder 18 and the radial lines 45, 46 to the outer cylindrical surface of the form cylinder 18, where it expands the sleeve 96 in the non-printing region of the sleeve, thus allowing the sleeve to be lifted up from the form cylinder 18 by a removal device. After this, a replacement sleeve is placed on the form cylinder 18, with pressurized air again being used. After all movement steps have been carried out in the reverse order, it is possible for the rotary printing machine 16 to print again using the form cylinder 18. The actual physical removal of the sleeve from the cylinder can be accomplished in various ways that are known to those skilled in the art and will not be discussed here.

Figure 2:
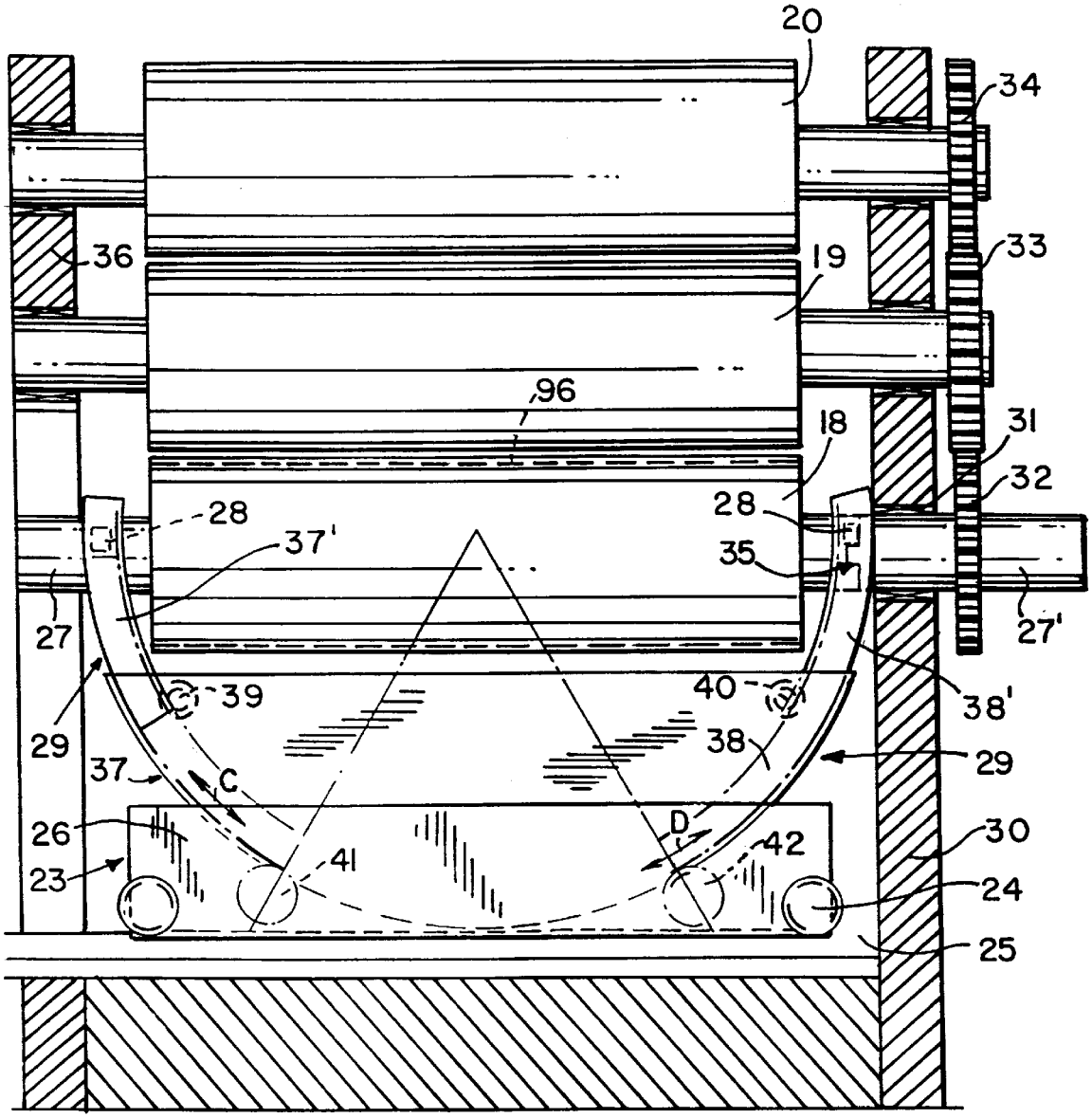
FIG. 2 is a sectional view of the printing machine in FIG. 1, along Line A—A.
Figure 4:
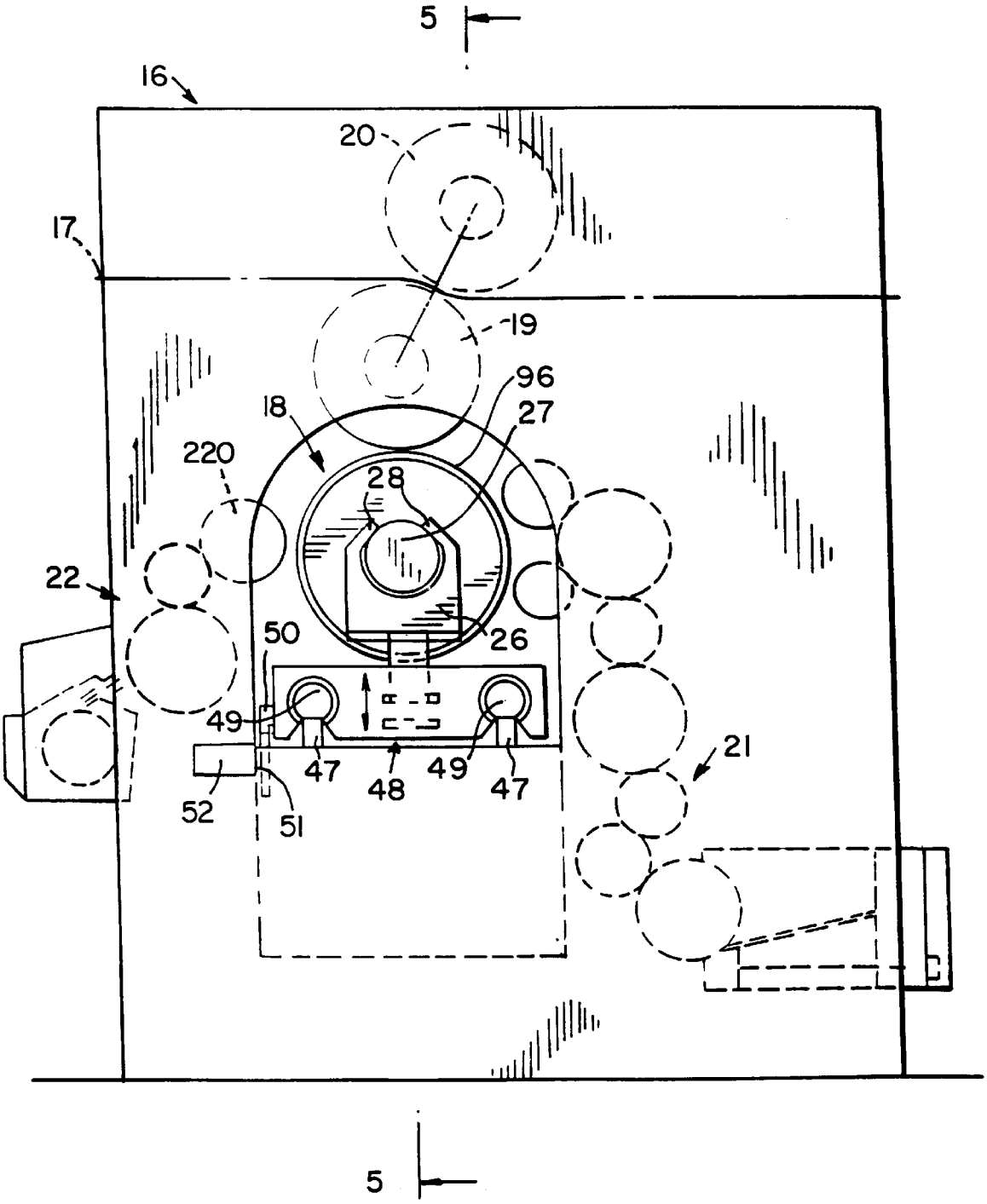
FIG. 4 is a side view of another printing machine.

Instead of the transport car 23 shown in FIGS. 1 to 3, a carriage 48 that runs on ball guides 47 (FIGS. 4, 5) can also be used. Like the transport car 23, the carriage 48 has a holder 26 and a positioning device 29 located thereon with clamping jaws 28 for the purpose of holding the journals 27, 27' of the form cylinder 18. Parallel ball guides 47 accommodate balls 49 on which the transport carriage 48 rests. A toothed rod 50, which meshes with the driving toothed gear 51, drives the transport carriage 48 along the ball guides 47 via the balls 49. The toothed rod 50 is attached laterally to the transport carriage 48, so that the transport carriage 48 can be moved out of and back into the rotary printing machine 16. The driving toothed gear 51 is itself driven by an electric motor 52, for example.

Figure 6:
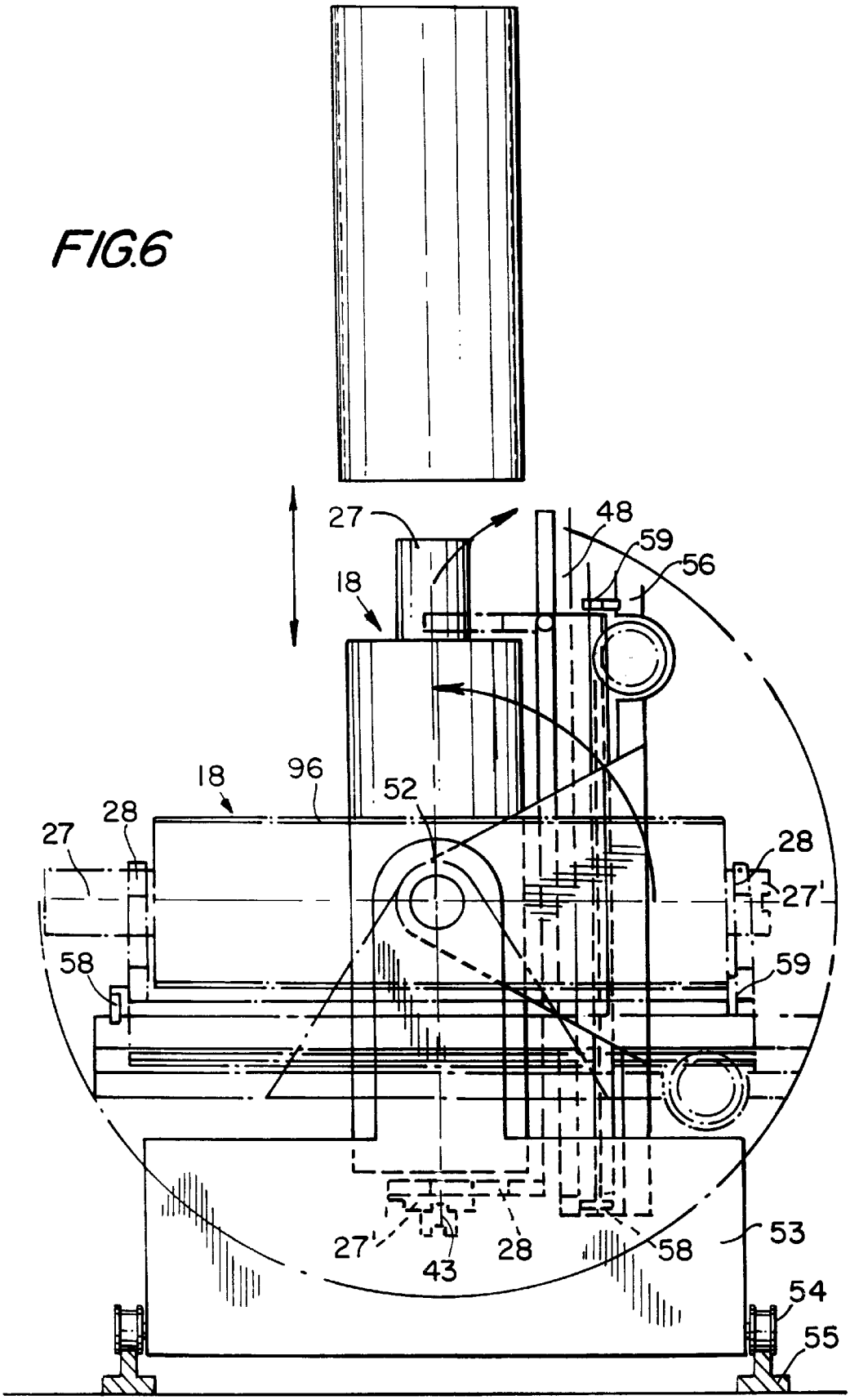
FIG. 6 shows another transport means, which carries a form cylinder removed from the printing machine in FIG. 4.

According to FIG. 6, the transport carriage 48 is moved on a manipulator 53. The manipulator 53 itself can be moved by means of rollers 54, which ran on tracks 55, for example, on a plane in a direction perpendicular to the movement direction of the transport carriage 48. The manipulator 53 is equipped with a tilting device 56, which can be tilted around a point of rotation 57. The transport carriage 48 is secured to the tilting device 56 by stopping means 58, 59. Together with the tilting device 56, the carriage 48 is then turned by 90°, so that when pressurized air is supplied by the pressurized air feed 43, the sleeve 96 can be expanded, as shown in FIG. 3, in order to remove the sleeve 96 from the form cylinder 18.

The invention provides a printing machine, particularly an offset printing machine, having a form cylinder 18, which is covered by a sleeve 96 and which can be moved out of the printing machine in order to exchange the sleeve 96. The form cylinder is first moved horizontally by a horizontally movable device, i.e., a transport car 23 or a transport carriage 48. Then, having been moved out of the printing machine, the form cylinder is swung into a vertical position.

Figure 5:
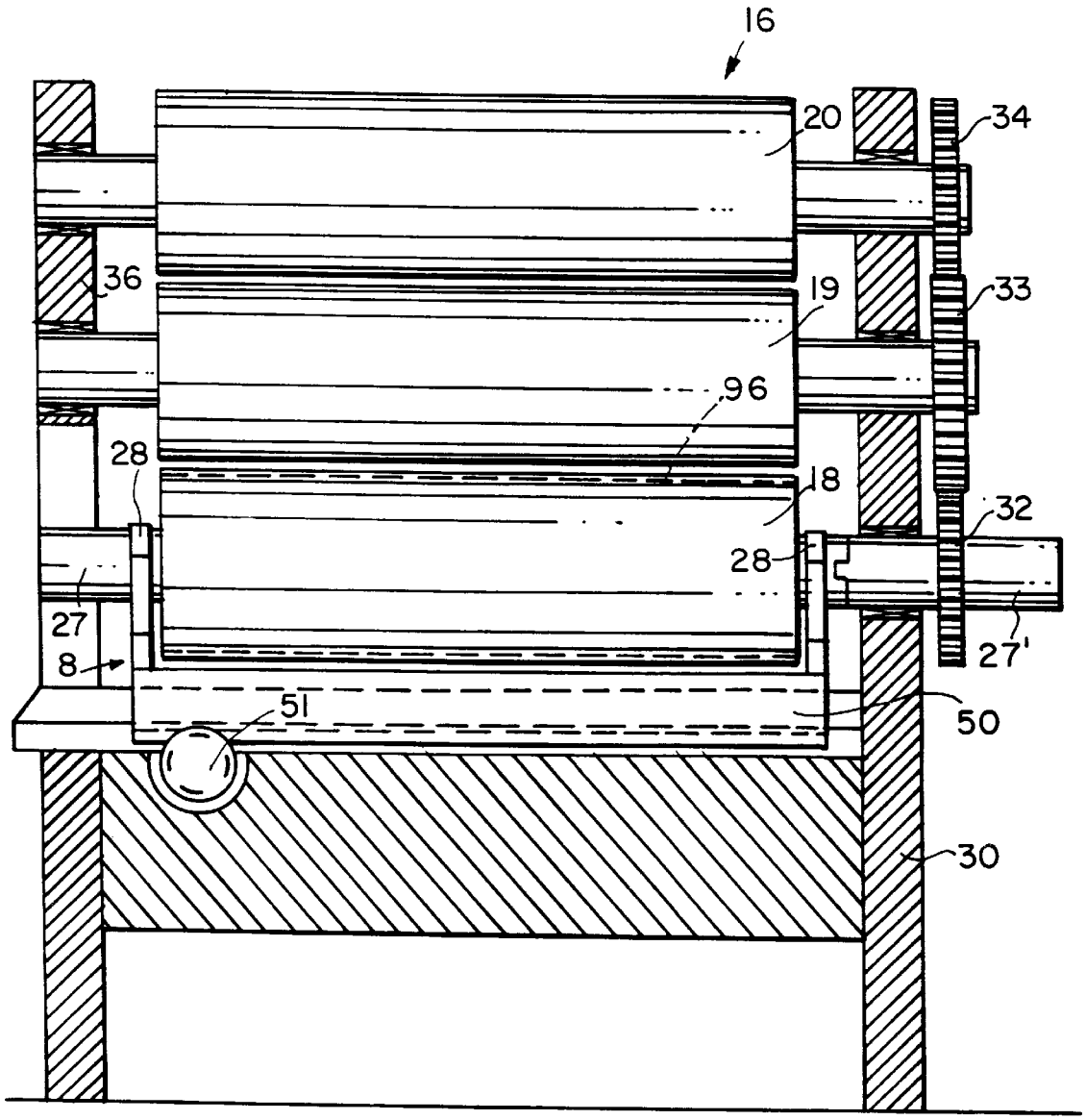
FIG. 5 is a sectional view of the printing machine in FIG. 4, along Line B—B.

The sleeve 96 can preferably be removed upwardly from the form cylinder, whereupon the form cylinder, because of its weight, remains in the vertical position and is held at its journal 27' by the clamping jaw 28. This process avoid tipping or damaging the sleeve 96. Furthermore, unnecessary high bearing loads, such as those which occur upon the removal of the form cylinder from the printing machine known according to U.S. Pat. No. Re. 33,944, are avoided. As an alternative to running the transport car 23 or the transport carriage 48 on rollers 24 or balls 49, these can also be mounted and run on skids. Instead of the tracks 25, round or flat strips can also be used for guidance inside and outside of the printing machine. Telescopic holding devices are also suitable for holding the form cylinder 18 on one or two sides. As shown in FIGS. 2 and 5, the printing machine 16 intended for the form cylinder change permits access to the form cylinder 18 on at least one face end. There is an opening in at least one of the two side walls 30, 36. The form cylinder 18 to be exchanged has a coupling 35 for its release from and return to the printing machine 16.

The printing machine according to the invention is especially suitable when a printing form is to be erased, imaged and fixed outside of the printing machine. The invention disconnects imaging from printing, so that productivity is increased compared to conventional printing processes. A sleeve can be changed much more quickly than a sleeve can be imaged within the printing machine. This means that while printing is carried out with a first sleeve 96, a second sleeve can in the meantime be imaged outside of the printing machine.

The invention is not limited by the embodiments described above which are presented as examples only but can be modified in various ways within the scope of protection defined by the appended patent claims.

We claim:

1. A printing machine, comprising: side walls; at least one cylinder having an outer cylindrical surface carrying a removable sleeve, the cylinder having two journals and being removably mounted in the side walls; bearing means for rotatably supporting the journals in the sidewalls, at least one of the side walls having an opening; and transport means for moving only the cylinder back and forth through the opening in the side wall and for manipulating the cylinder removed from the printing machine so that the sleeve of the cylinder removed from the printing machine can be exchanged for a replacement sleeve and the cylinder with the replacement sleeve can be moved back into the printing machine directly into a printing position, the transport means including holder means for holding only one of the journals during removal of the sleeve from an end of the cylinder opposite the one journal whereby the journal at the end of the cylinder opposite the one journal being unsupported during removal of the sleeve.

2. A printing machine as defined in claim 1, wherein the transport means includes a transport carriage.

3. A printing machine as defined in claim 1, wherein the transport means includes a transport car.

4. A printing machine as defined in claim 1, wherein one of the journals of the cylinder has a first part, a second part and a coupling configured so that the first part of the drive-side journal remains in one of the side walls and the second part of the journal remains with the cylinder and can be moved out of the printing machine by the transport means.

5. A printing machine as defined in claim 1, wherein the holder means is a positioning device having clamping jaws configured to hold the journals of the cylinder.

6. A printing machine as defined in claim 5, wherein the positioning device includes movable segments configured to hold the cylinder at its journals.

7. A printing machine as defined in claim 1, wherein the transport means includes a tilting device operative to tilt the cylinder.

8. A printing machine as defined in claim 3, wherein the transport means further includes rails, and rollers connected to the transport car and guidable by the rails.

9. A printing machine as defined in claim 2, wherein the transport means further includes ball guides, and a plurality of balls arranged in the transport carriage so as to be engaged with the ball guides so that the transport carriage can be moved along the ball guides via the balls.

10. A printing machine as defined in claim 9, wherein the transport means further includes a toothed rod attached to a side of the transport carriage, and a toothed driving gear in driving engagement with the toothed rod whereby the transport carriage can be moved.

11. A printing machine as defined in claim 1, and further comprising pressurized air feed means arranged in the transport means for introducing pressurized air into the cylinder after the cylinder is moved out of the printing machine so that the sleeve can be detached from the cylinder.

12. A printing machine as defined in claim 1, wherein the cylinder is a form cylinder, and further comprising a transfer cylinder having an outer cylindrical surface on which a sleeve is removably mounted, the transport means being operative to selectively move the form cylinder and the transfer cylinder.

13. A printing machine as defined in claim 1, and further comprising means for removing the sleeve from the cylinder and installing the replacement sleeve on the cylinder.

* * * * *